United States Patent [19]

Maeda

[11] Patent Number: 4,999,243

[45] Date of Patent: Mar. 12, 1991

[54] FAR INFRA-RED RADIANT COMPOSITE FIBER

[76] Inventor: Nobushige Maeda, 3-14-11, Shimo-Shakujii, Nerima-ku Tokyo, Japan

[21] Appl. No.: 427,950

[22] Filed: Oct. 25, 1989

Related U.S. Application Data

[63] Continuation of Ser. No. 132,168, Dec. 14, 1987, abandoned.

[30] Foreign Application Priority Data

Dec. 15, 1986 [JP] Japan ..... 61-298098

[51] Int. Cl.[5] ..... D02G 3/00

[52] U.S. Cl. ..... 428/372; 428/359; 428/362; 428/370; 428/373; 428/374; 428/376; 428/398; 428/401

[58] Field of Search ..... 428/372, 373, 374, 375, 428/379, 380, 383, 384, 389, 370, 359, 362, 398, 376, 401, 913

[56] References Cited

U.S. PATENT DOCUMENTS 3,015,873 1/1962 Dietzsch et al. ..... 428/398
3,658,634 4/1972 Yanagi et al. ..... 428/373
3,718,534 2/1973 Okamoto et al. ..... 428/397
4,207,376 6/1980 Nagayasu et al. ..... 428/373 X
4,420,534 12/1983 Matsui et al. ..... 428/379 X

*Primary Examiner*—Lorraine T. Kendell
*Attorney, Agent, or Firm*—Fleit, Jacobson, Cohn, Price, Holman & Stern

[57] ABSTRACT

There is disclosed a far infra-red radiant composite fiber composed of a core polymer containing 10 to 70 percent by weight of a far infra-red radiant grained material covered with a sheath polymer containing 1 to 10 percent by weight of a far infra-red radiant grained material. The above far infra-red radiant grained material in core polymer and the above far infra-red radiant grained material in sheath polymer have a far infra-red emissivity of 65% or over on an average in the spectral range from 4.5 μm to 30 μm at 30° C. Such fiber can be woven or knitted into fabrics to wear or otherwise used to exert a warming effect on human body and thereby facilitate blood circulation, resulting in favorable effects in medical care and therapy as well as in health enhancement. Because of the sheathed fiber construction with a sheath polymer containing a low content of grained material, the fiber can be produced and treated as smooth as the ordinary sheathed composite fiber.

14 Claims, 3 Drawing Sheets

FAR INFRA-RED RADIANT COMPOSITE FIBER

This is a continuation of application Ser. No. 132,168, filed Dec. 14, 1987, and now abandoned.

FIELD OF THE INVENTION

This invention relates to a fiber that emits far infra-red radiation.

There has so far not been put to practical use any fiber containing a radiant material that emits far infra-red radiation below 200° C. and particularly in such a moderate temperature range from 20° to 50° C. being capable of exerting a warming effect on a human body.

It has been widely known that ceramics, alumina, zirconia, magnesia and mixtures composed of two or more of these materials emit far infra-red radiation. It is also known that the far infra-red radiation exerts a warming effect on a human body and further that exposure of the human body to far infra-red radiation induces hyperemia and facilitates blood circulation, resulting in some therapeutic and health enhancing effects. As a result, there has been used far infra-red radiant equipment or the like capable of radiating a far infra-red beam at several hundred degrees C.

BRIEF SUMMARY OF THE INVENTION

Applicants have discovered that a composite fiber wherein a core polymer containing a high content of a far infra-red radiant grained material covered with a sheath polymer containing a low content of the radiation both from the sheath and core portion of fiber. This idea led the author to the present invention.

Accordingly, an object of the invention is to provide a far infra-red radiant composite fiber composed of a core polymer containing a high content a far infra-red radiant grained material covered with a sheath polymer containing a low content of a far infra-red radiant grained material.

It is noted that because of the smoother surface of the sheath containing less grains the above far infra-red radiant composite fiber of the invention can readily be fabricated by on composite spinning process of known art.

It is also noted that the above fiber can be woven or knitted into fabrics to be worn by human body or otherwise used to exert a warming effect on the human body and thereby facilitate blood circulation, resulting in favorable effects in medical care and therapy as well as in health enhancement.

BRIEF DESCRIPTION OF THE DRAWINGS

Other and further objects, features and advantages of the invention will appear more fully from the detail description with reference to the accompanying drawings, wherein.

DETAILED DESCRIPTION

The far infra-red radiant composite fiber embodying the invention is characterized by a sheathed construction wherein the core polymer contains 10 to 70 percent by weight of a far infra-red radiant grained material while the sheath polymer contains 1 to 10 percent by weight of a far infra-red radiant grained material, these grained materials having a far infra-red radiant emissivity not lower than 65% on an average at 30° C. in a spectral region from 4.5 to 30 μm.

The far infra-red radiant grained material that can be used in the invention must have a far infra-red emissivity of at least 65%, preferably 74% or over, and more preferably 90% or over on an average in a spectral emissivity of 65% is the minimum requirement for the grained material to exert a positive warming effect on a human body. A material with a lower emissivity will give little warming effect on human body and therefore fail to achieve the intended objects of the invention.

For the above far infra-red radiant grained materials, some oxide ceramic materials, non-oxide ceramic materials, non-metals, metals, alloys, crystalline salts, etc. may be used. Examples of the applicable oxide ceramic material are, beside alumina ($Al_2O_3$), magnesia (MgO) and zirconia ($ZrO_2$), titanium oxide ($TiO_2$), silicon dioxide ($SiO_2$), chromium oxide ($Cr_2O_3$), ferrite ($FeO_2$, $Fe_3O_4$), spinel ($MgO.Al_2O_3$), celium dioxide ($CeO_2$), barium oxide (BaO), etc. The above non-oxide ceramic materials include carbides and nitrides. Examples of the applicable carbide ceramic material are boron carbide ($B_4C$), silicon carbide (SiC), titanium carbide (TiC), molybednum carbide (MoC), and tungsten carbide (WC). Examples of the applicable nitride ceramic material are boron nitride (BN), aluminium nitride (AlN), silicon nitride ($Si_3N_4$), and zirconium nitride (ZrN). Further, an example of the applicable non-metal material is carbon (C) and particularly graphite. Examples of the applicable metal material are tungsten (W), molybednum (Mo), vanadium (V), platinum, (Pt), tantalum (Ta), manganese (Mn), nickel (Ni), copper oxide ($Cu_2O$), and ferrous oxide ($Fe_2O_3$). Examples of the applicable alloy are nichrome, Kanthal alloy, stainless steel, and alumel. And examples of the applicable crystalline salt are mica, fluoride, calcite, alum, and rock crystal.

Figure 1:
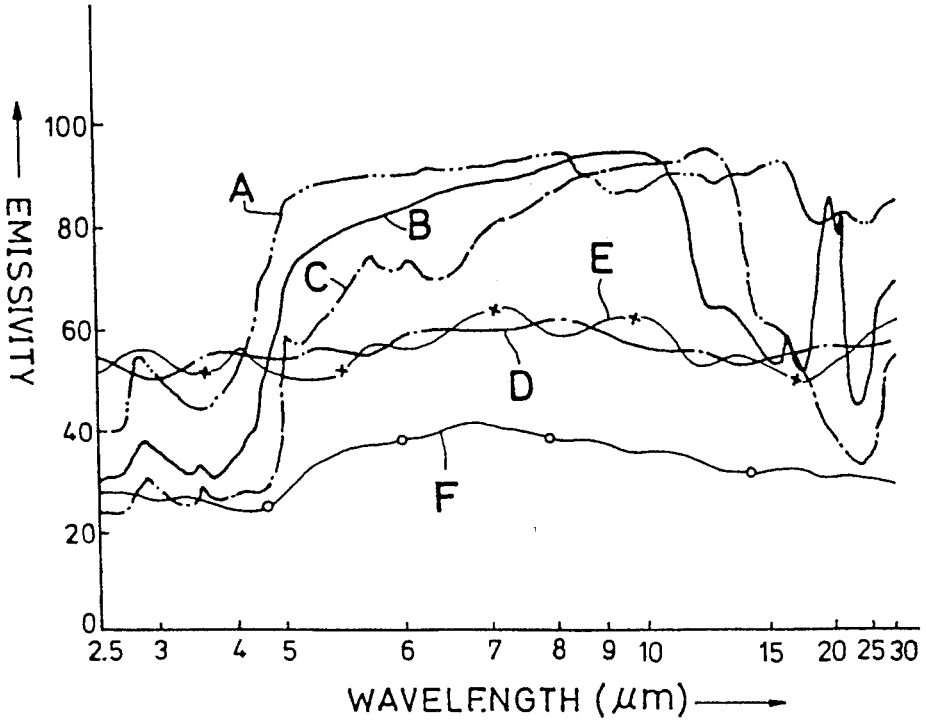
FIGS. 1 through 4 are graphs showing the spectral distribution of the emissivity of various ceramic materials in the far infra-red region, FIG. 1 referring to various single component ceramic materials, FIG. 2 to two mixed ceramic materials, FIG. 3 to two alumina materials of different purities, and FIG. 4 to two murite materials of different purities.

FIG. 1 is the spectral distribution of emissivity of some oxide ceramic samples. The curves A, B and C refer to alumina, magnesia and zirconia, respectively. In the spectral region of 4.5 μm to 30 μm, each of these curves presents a mean emissivity over 75%, so the above three samples are applicable in the present invention. Further, the curves D and E in the same figure refer to zirconium carbide and titanium nitride samples, respectively, both being non-oxide ceramic materials. Both curves present a mean emissivity below 60% in the aforementioned spectral region, so these non-oxide ceramic samples may not be used alone in the invention. The curve F is the emissivity curve with a ceramic sample made of transparent quartz. This sample has a mean emissivity below 40% and therefore may not be used alone in the invention.

Factors of determining the far infra-red emissivity of a material as given by spectrometry are the chemical species, purity, grain size, crystalline type (tetragonal, hexagonal, monoclinic, cubic, trigonal, or rhombic system), etc. of the material.

Among other ceramic materials, alumina, magnesia, zirconia and titania are endowed with particularly favorable far infra-red radiant characteristics. Examples of the applicable alumina ceramic material are ordinary alumina and murite. Examples of the applicable magnesia material are ordinary magnesia and cordierite. And examples of the applicable zirconia material are zircon sand ($ZrO_2.SiO_2$) and zircon ($ZiO_2$). An Example of the applicable titania is titanium oxide. The alumina, magnesia, zirconia and titania materials as mentioned above can be effectively used independently or in combination by mixing. Further, one or more of these materials can be mixed with a ceramic material or materials of a different kind or kinds (for example, a carbide ceramic material) for effective use.

Figure 2:
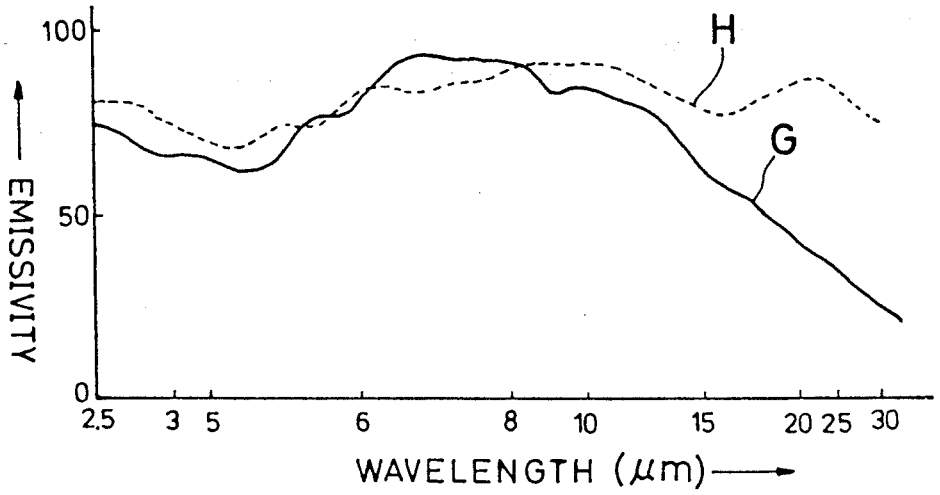

FIG. 2 is the emissivity curves with two mixed ceramic samples. The curve G refers to a mixed ceramic material composed of zirconia ($ZrO_2$) and chromium oxide ($CrO_2$) in the 1/1 weight ratio while the curve H to another mixed ceramic material composed of alumina ($Al_2O_3$) and magnesia (MgO) in the 1/1 weight ratio. These curves show that both mixed ceramic materials are useful for the invention.

Figure 3:
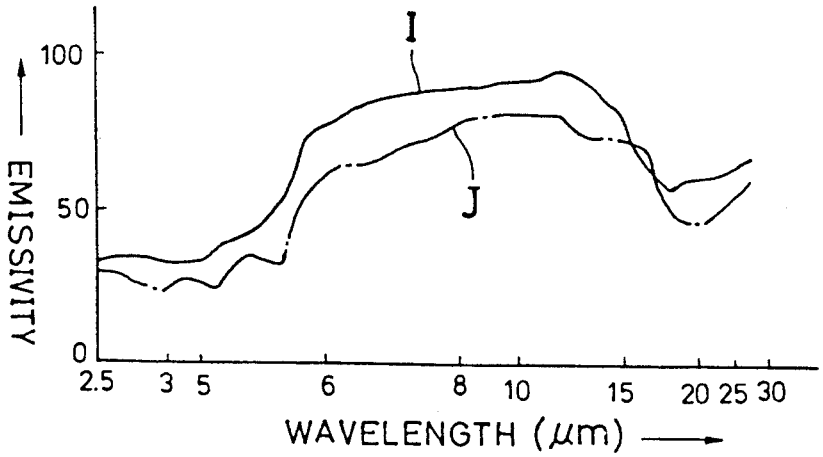
Figure 4:
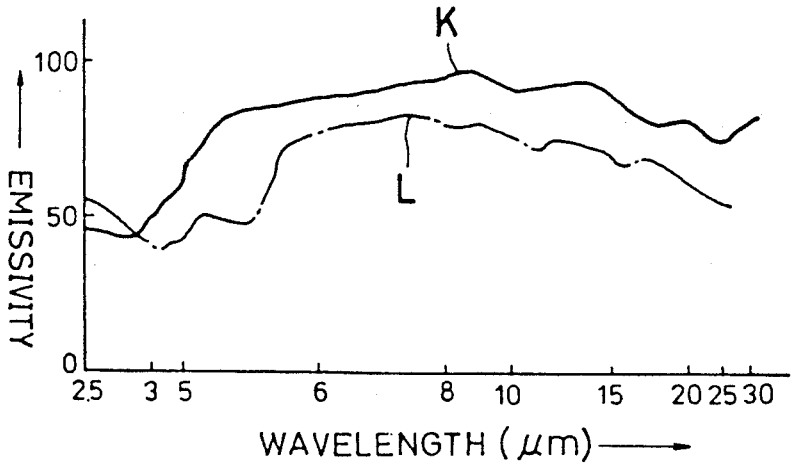

For the above far infra-red radiant ceramic materials, a higher purity is often preferable, a purity over 95% sometimes giving a high far infra-red emissivity. For example, in FIG. 3, emissivity curves I and J refer to alumina of purity 95% and 85%, respectively, and in FIG. 4 curves K and L refer to murite of purity 95% and 85%, respectively. In both figures, a higher purity gives a higher emissivity curve.

The far infra-red radiant material used in the invention is preferably grained fine enough to give no practical difficulty in fabricating the sheathed composite fiber of the invention. Though in case of thicker fiber a grain size of 5 μm to 20 μm might be used, ordinarily, a preferable grain size is between 0.1 μm and 5 μm and particularly between 0.2 μm and 1.5 μm. However, a ceramic material with an excessively small grain size below 0.1 μm is liable to aggregation and inconvenient for use in many other points.

To the sheath polymer of the composite fiber of the invention, the far infra-red radiant grained material must be added to a content of 1 to 10 percent by weight. For fiber formation, a lower content is preferable. Particularly, since the sheath comes in direct contact to guides and other mechanical parts of the spinning machine, drawing machine, knitting machine, weaving machine, etc. in the production process, a higher content of the grained material would sometimes result in heavy wear of these parts. A manufacturing test revealed that the content of the grained material must be controlled to 10 percent by weight or under and often preferably at least 5 percent by weight lower than the content of the grained material in the core polymer. The content of the grained material in the sheath polymer is often preferably between 1 and 5 percent by weight. Further, the material is often preferably grained as edgeless as possible in the almost rounded form. Titanium oxide ($TiO_2$) is one of the preferable far infra-red radiant grained materials. On the other hand, a higher content of the far infra-red radiant grained material in the sheath polymer is preferable to achieve a higher performance in the far infra-red radiant characteristics. As a result of evaluation tests made by the present inventor, 1 percent by weight addition of the grained material to the sheath polymer is enough to reveal a definite effect, which is augmented with an increasing content. Such addition of the far infra-red radiant grained material even at a low content into the subsurface sheath layer of composite fiber is effective in intensifying the far infra-red radiation that is emitted since the far infra-red absorption by polymer is reduced correspondingly.

To the core polymer of the composite fiber of the invention, the far infra-red radiant grained material must be added to 10 to 70 percent by weight. The far infra-red radiation is emitted primarily from the core portion of the composite fiber, so that the minimum requirement is a content of 10 percent by weight. However, a too high content of the far infra-red radiant grained material often impairs the mechanical strength of the composite fiber, resulting in a lower yield in the fiber forming process, so that the grained material content of the core polymer must be 70 percent by weight or under. The optimum content of the grained material, though dependent on the grain shape, the chemical species of grained material, etc., is thus preferably between 20 and 70 percent by weight and more preferably between 30 and 60 percent by weight.

The far infra-red radiant composite fiber of the invention is characterized by a sheathed fiber construction wherein the core polymer containing a high content of a far infra-red radiant grained material is covered with the sheath polymer containing a low content of a far infra-red radiant grained material. The sheath itself is thus endowed with some far infra-red radiant characteristics while providing protection of the far infra-red radiant core portion and easing formation of such fiber and fabrication of fibrous structures (woven and non-woven fabrics, knitting, etc.) from such fiber. Namely, if the core polymer containing a high content of the far infra-red radiant grained material is exposed, mechanical parts such as guides of the spinning machine, drawing machine, knitting machine, weaving machine, etc. are liable to severe wear and damages as these parts are directly rubbed with such core polymer. To prevent the above difficulties, it is necessary to cover the core polymer with a sheath polymer containing a lower content of the grained material.

Figure 7:
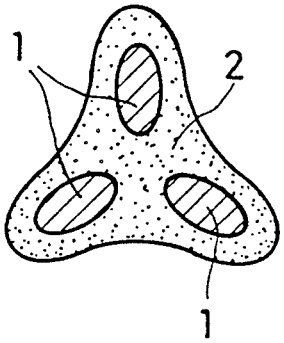
Figure 8:
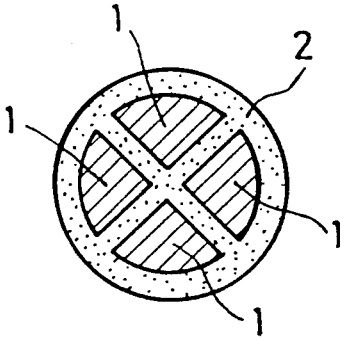
Figure 9:
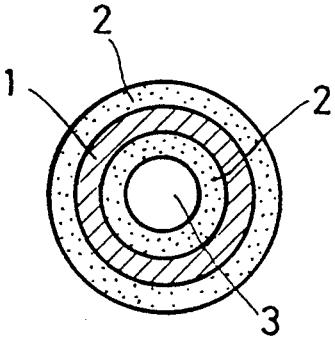
Figure 10:
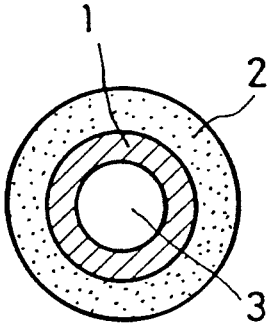
Figure 11:
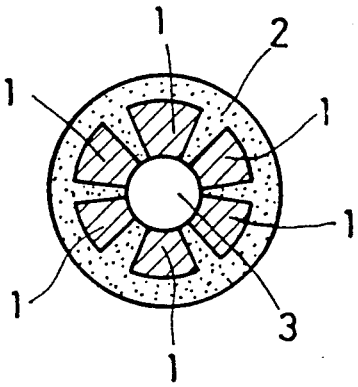

FIGS. 5 through 11 are examples of possible fiber constructions in cross section of the composite fiber embodying the invention. In these drawings, the core portion 1 is covered with the sheath 2. Since the polymer of the sheath absorbs far infra-red radiation, the sheath is preferably made as thin as possible, ordinarily thinner than 10 μm and preferably thinner than 5 μm. FIGS. 7, 8 and 11 are examples of the composite fiber embodying the invention wherein the core portion is partitioned into a plurality of compartments in cross section. These examples are sometimes preferable, since the sheath 2 can be made thinner while preserving the mechanical strength of the fiber as a whole. FIGS. 9 through 11 are examples of the composite fiber of the invention having a hollow space 3. These examples are sometimes preferable to dispose the core portion 1 toward the outer layer as much as possible.

The core portion 1 and sheath 2 may be composed either of the same kind or different kinds of polymer, to which polymer materials that have more commonly been used for clothing may be applied. Preferable examples of the applicable polymer material are polyolefin, polyamide, polyester, and polyacrylonitrile. The polymer material or materials used for the core portion 1 and sheath 2 are preferably characterized by low absorbance of the far infra-red radiation in the spectral region from 4.5 μm to 30 μm and high transparency thereto.

Polyethylene is superior as a polymer of high transparency to the far infra-red radiation. The low density polyethylene has a softening point of 105° C. while the high density polyethylene has a melting point of 128° C.. These polymers are thus somewhat inferior in thermal resistance and limited to use at rather moderate temperatures but still available for applications to produce a warming effect on a human body. However, with additional cross-linkage established, for example, by irradiation with radioactive rays, these polyethylene polymers can be improved in thermal resistance so much as to have softening points above 200° C. and become preferable to achieve the intended objects of the invention. Polymers that are next to polyethylene in the transparency to the far infra-red radiation are, for example, nylon 12, nylon 11, nylon 610, nylon 612, and copolymer versions thereof containing polyethylene. Further, polypropylene, polyvinyl chloride, polyvinyl alcohol, polyacrylonitrile, polyacrylate, nylon 6, nylon 66, polyethylene terephthalate, polybutylene terephthalate, and copolymer versions thereof can provide a sheath less absorptive of far infra-red radiation for a higher emissivity of such radiation, as long as the sheath is made thin. To the composite fiber of the invention whose sheath also contains a far infra-red radiant grained material, the above polymers are particularly preferable to apply.

The composite fiber of the invention can be fabricated by a composite spinning process of known art. Spinning, drawing, heat treatment, etc. can thus be made at the ordinary feed rate, resulting in fiber products with half or full molecular orientation of polymer. The core portion of the composite fiber containing a high content of far infra-red radiant grained material, which is covered with a sheath containing a low content of far infra-red radiant grained material, does not come in direct contact to the spinning nozzle, guide, roller, traveler, hot plate, etc., so that these mechanical parts wear less. Accordingly, the above fiber can be produced by the same process as applied to the ordinary composite fiber. The composite fiber in the crimpled form, in the continuous filamentous form without crimpling or in the form of staple can be worked alone or in combination with an ordinary fiber material or materials by the same method as normally used to assemble woven or nonwoven fabric, knitting, piled woven fabric or knitting, etc. Further, fiber products for which a satisfactory performance in maintaining warmth is a requirement, for example, underwear, socks, stockings, sweater, outer garment, sportswear, curtain, glove pat, and shoe lining can readily be manufactured by conventional methods.

To further illustrate this invention, and not by way of limitation, the following examples are given.

EXAMPLE 1

Anatase type titanium oxide of a mean grain size of 0.4 μm was added 0.3% to powdery polymer P-0 of nylon 6 whose intrinsic viscosity was 1.19 in methacresol at 25° C. to produce a polymer compound P-1. Meanwhiles, 30 parts by weight of gamma alumina of a purity above 99% and mean grain size of 0.6 μm and 30 parts by weight of polyethylene wax were kneaded together and added to 60 parts by weight of powdery polymer P-0. The mixture was kneaded on a double spindle kneader to give a polymer compound PC-1. Using various ceramic materials, the same process was repeated to prepare polymer compounds PC-2 to PC-6 as listed in Table 1.

TABLE 1

| Polymer compound | Ceramic material | Purity | Mean grain size, μm |
|---|---|---|---|
| PC-1 | Gamma alumina | Over 99% | 0.6 |
| PC-2 | Alpha alumina | Over 99% | " |
| PC-3 | Gamma alumina | 85% | " |
| PC-4 | Murite | Over 99% | " |
| PC-5 | Zirconium carbide | Over 99% | " |
| PC-6 | Titanium nitride | Over 99% | " |

Figure 5:
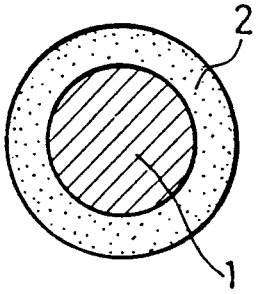
FIGS. 5 through 11 are cross-sectional views showing various possible constructions of the far infra-red radiant composite fiber embodying the invention.
Figure 6:
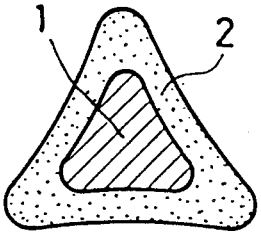

Next, through the melt composite spinning process, the polymer compounds PC-1 and P-1 were extruded together from an orifice of 0.25 mm in diameter at 270° C. at such a setup that a composite fiber was fabricated with the core of polymer compound PC-1 and the sheath of polymer P-1 as shown in FIG. 5 (volume compounding ratio of 1/1). The fiber was cooled, oiled and then wound up at a rate of 800 m/min. This undrawn fiber was drawn 3.2 times as long to have a drawn fiber Y-1. Using polymer compounds PC-2 to PC-6 instead of PC-1, the above process was repeated for spinning and drawing to have drawn fibers Y-2 to Y-6, respectively. Further, using polymer compound P-1 and polymer P-0 alone, drawn fibers Y-7 and Y-8, respectively, were also formed. These drawn fibers Y-1 to Y-8 were sized 70d/24f.

For comparison, it was tried to spin another fiber using the polymer compound PC-1 alone and under the same condition as above, but spinning was not successful because of frequent breaking of fiber. With the alumina content reduced to 15%, there was successful spinning though still with some incidence of fiber breaking. At the next drawing and twisting steps, however, such fiber wore the traveler so heavily that drawing and twisting could not be continued even just for 30 min. Beside the traveler, mechanical parts that were rubbed with the polymer compound PC-1, for example, the spinning orifice on the spinning machine, the fiber guide and traverse guide, etc. on the fiber winder, and the fiber guide on the drawing and twisting machines were heavily worn and damaged, suggesting considerable difficulties in applying this method to commercial production. Further, at subsequent steps of false twisting, warping, weaving, knitting, etc., mechanical parts were heavily damaged and/or worn as these parts were rubbed with the fiber. By contrast, with the above drawn fibers Y-1 to Y-7, spinning and drawing were as smooth as with the ordinary drawn fiber Y-8.

Next, each of the drawn fibers Y-1 to Y-8 was false twisted and a pair of fibers were set side by side for covering to produce a spandex of 40d, which was used in combination with mixed yarn of count 32 composed of 70% cotton fiber and 30% acrylic fiber to tentatively knit casual socks on a 2-feeder knitting machine. Socks S-1 to S-8 were thus made from drawn fibers Y-1 to Y-8, respectively.

S-1 to S-7 socks were individually paired with a S-8 sock and worn by 150 panelers for testing. Enquiry about any sensible difference in warmth gave results as given in Table 2.

TABLE 2

| Sock | Ceramic material in core polymer | Wearing test results* |
|---|---|---|
| S-1 Invention | Gamma alumina | 68% |

TABLE 2-continued

| Sock | Ceramic material in core polymer | Wearing test results* |
|---|---|---|
| S-2 Invention | Alpha alumina | 47% |
| S-3 Invention | Gamma alumina | 49% |
| S-4 Invention | Murite | 61% |
| S-5 Control | Zirconium carbide | 9% |
| S-6 Control | Titanium nitride | 11% |
| S-7 Control | — | 2% |
| S-8 Control | — | Standard |

*Percentage of panelers who felt some sensible preference of each test sock in warmth in comparison to the control sock S-8 worn in pair.

More than 60% of the panelers felt sensible preference of the socks S-1 and S-4 from the reference standard S-8, indicating that the composite fiber of the invention to which gamma alumina or murite of high purity is used provides higher performance in maintaining warmth. With the sock S-3 to which gamma alumina with 15% impurities including clay was applied, 49% of the panelers felt sensible preference, suggesting that use of a ceramic material of higher purity is preferable. With the sock S-2 to which alpha alumina of high purity was applied, only 47% of panelers recognized sensible preference. This finding suggested that the same alumina material might change in the mentioned performance depending on the physical properties and structural type thereof.

It is thus preferable to check various ceramic materials in far infra-red radiant characteristics and select one with best performance. With the socks S-5 and S-6 to which zirconium carbide and titanium nitride were applied, respectively, only 8% and 11%, of panelers felt sensible preference. It is thus found that these materials are almost ineffective in maintaining warmth at rather low temperatures.

With the sock S-7 to which only polymer PC-1 was applied, almost no paneler felt sensible preference, suggesting that no positive effect could be expected by addition of titanium oxide to the core polymer at a concentration so low as 3%. The objects of the invention can thus be achieved by use of a core polymer rich in a far infra-red radiant grained material.

EXAMPLE 2

Drawn fibers Y-1 and Y-7 as used in Example 1 were woven into taffetas T-1 and T-7, respectively, which were dyed to flesh color in the same acidic dye vat. Compared to the ordinary taffeta T-7, the taffeta T-1 was tinted slightly in pastel tone though with only very slight difference between the two. The core-sheath type composite fiber Y-1 whose sheath was made of the same polymer as applied to the drawn fiber Y-7 was thus found to have such a merit that the fiber could be dyed smoothly with almost no appreciable difference from the ordinary fiber.

In a test to check the performance in maintaining warmth, thermal radiation ($W/m^2$) from these taffetas T-1 and T-7 were determined by a far infra-red power meter in a laboratory kept at 36° C. The results were 420 $W/m^2$ and 385 $W/m^2$, respectively, indicating a satisfactory performance of the taffeta T-7. Taffeta T-7, when used as bed sheet, was not only felt warm but found effective in facilitating blood circulation, thus exhibiting very preferable performances.

EXAMPLE 3

A fiber F-1 of triangular cross-section sized 70d/18f was formed by the melt spinning/drawing process with use of polyethylene of molecular weight of 90,000. Further, using a polymer compound prepared by kneading 70 parts by weight of the same polyethylene and 30 parts by weight of gamma alumina of purity over 99% and mean grain size of 0.6 μm on a double spindle kneader for the core polymer and the same nylon polymer P-0 as used in Example 1 for the sheath, a composite fiber F-2 sized 70d/18f was formed by the melt composite spinning/drawing process (volume compounding ratio: 1/1). Further, the same melt composite spinning/drawing process was repeated except that 3% titanium oxide and 3% above gamma alumina were added to nylon polymer P-0 and the mixture was kneaded and used for the sheath instead of polymer P-0. A fiber F-3 sized 70d/18f was thus formed. Fibers F-1 to F-3 were woven into taffetas T-1 to T-3.

Thermal radiation ($W/m^2$) from taffetas T-1 to T-3 was determined by a far infra-red power meter in a laboratory kept at 36° C. Table 3 is the results. In case of taffeta T-3, fiber core gamma alumina together with minor quantities of fiber sheath gamma alumina and titanium oxide emitted higher thermal radiation in total. By contrast, taffeta T-2 emitted insufficient thermal radiation since the sheath of composite fiber of which the taffeta was woven contained no far infra-red radiant grained material and therefore just absorbed far infra-red radiation.

TABLE 3

| Taffeta | Thermal radiation, $W/m^2$ |
|---|---|
| T-1 Control | 380 |
| T-2 Control | 400 |
| T-3 Invention | 415 |

According to the far infra-red radiant composite fiber of the invention, a far infra-red radiant grained component or components of composite fiber emit far infra-red radiation. If such composite fiber is applied to the underwear, socks, sweater, outer garment, lining of boots, and others worn by human body, therefore, a far infra-red radiation is emitted to exert an effect to facilitate thermal motions of molecules in human body resulting in self heat generation therein. This means most suitable clothing for use in cold district. Further, these clothing, if worn by human body, induces hyperemia in short time, facilitating blood circulation, which may lead to some therapeutic effect and health enhancement. Beside the clothing as mentioned above, the composite fiber of the invention may be applied to curtain, carpet, etc. with an aim to keep the room warmer.

Further, the composite fiber of the invention in which the core portion containing much grains capable of wearing metal parts heavily is covered with a sheath containing less such grains has a merit that the same equipment can be applied to production processes from spinning to fabric production at the same condition as used with the ordinary composite fiber.

What we claim is:

1. A far infra-red radiant composite fiber composed of a core of fiber produced from a polyamide containing 10 to 70 percent by weight of a far infra-red radiant grained material covered with a sheath of fiber produced from a polyamide containing 1 to 10 percent by weight of a far infra-red radiant grained material, wherein said far infra-red radiant grained material in said core and said far infra-red radiant grained material in said sheath are selected from the group consisting of alumina, zirconia, titanium oxide, and mixtures thereof of a purity of at least 95%, and have a far infra-red emissivity of at least 65% on an average in the spectral range form 4.5 μm to 30 μm at 30° C.

2. A far infra-red radiant composite fiber composed of a core of fiber produced from a polyamide containing 10 to 70 percent by weight of a far infra-red radiant grained material covered with a sheath of fiber produced from a polyamide containing 1 to 10 percent by weight of a far infra-red radiant grained material, wherein said far infra-red radiant grained material in said core and said far infra-red radiant grained material in said sheath are selected from the group consisting of magnesia, murite, and mixtures thereof, each at least 95% in purity, and have a far infra-red emissivity of at least 65% on an average in the spectral range from 4.5 μm to 30 μm at 30° C.

3. A far infra-red radiant composite fiber as claimed in claim 1 wherein said far infra-red radiant grained material in said core and said far infra-red radiant grained material in said sheath have a mean grain size of 0.2 to 1.5 μm.

4. A far infra-red radiant composite fiber as claimed in claim 1 wherein said sheath has a maximum thickness of substantially 10 μm.

5. A far infra-red radiant composite fiber as claimed in claim 1 wherein said core is partitioned into separate compartments in cross section.

6. A far infra-red radiant composite fiber as claimed in claim 1 wherein said core and said sheath radially extend about a hollow space.

7. A far infra-red radiant composite fiber as claimed in claim 2 wherein said far infra-red radiant grained material in said core and said far infra-red grained material in said sheath have a mean grain size of 0.2 to 1.5 μm.

8. A far infra-red radiant composite fiber as claimed in claim 2 wherein said core and said sheath radially extend about a hollow space.

9. A far infra-red radiant composite fiber as claimed in claim 3 wherein said core and said sheath radially extend about a hollow space.

10. A far infra-red radiant composite fiber as claimed in claim 7 wherein said core and said sheath radially extend about a hollow space.

11. A far infra-red radiant composite fiber as claimed in claim 2 wherein said sheath has a maximum thickness of substantially 10 μm.

12. A far infra-red radiant composite fiber as claimed in claim 7 wherein said sheath has a maximum thickness of substantially 10 μm.

13. A far infra-red radiant composite fiber as claimed in claim 2 wherein said core is partitioned into separate compartments in cross section.

14. A far infra-red radiant composite fiber as claimed in claim 7 wherein said core is partitioned into separate compartments in cross section.

* * * * *